US005433359A

United States Patent [19]

Flowers

[11] Patent Number: 5,433,359

[45] Date of Patent: Jul. 18, 1995

[54] BODY MOUNTABLE CARRIER

[75] Inventor: Danny J. Flowers, St. Louis, Mo.

[73] Assignee: Grebler & Associates, Inc., St. Louis, Mo.

[21] Appl. No.: 262,025

[22] Filed: Jun. 17, 1994

[51] Int. Cl.[6] ..... A45F 5/00

[52] U.S. Cl. ..... 224/222; 224/267; 224/901; 24/306

[58] Field of Search ..... 224/901, 219, 220, 221, 224/222, 267; 24/306, 442; 128/DIG. 15; 2/311, 312, 333

[56] References Cited

U.S. PATENT DOCUMENTS

| | | | |
|---|---|---|---|
| 1,164,928 | 12/1915 | Corcoran | 224/222 |
| 3,160,158 | 12/1964 | Rayhart | 224/222 |
| 3,543,977 | 12/1970 | Lockridge | 224/5 |
| 3,747,171 | 7/1973 | Montague, Jr. | 224/901 |
| 4,135,653 | 1/1979 | Sieloff | 224/222 |
| 4,414,969 | 11/1983 | Heyman | 128/DIG. 15 |
| 4,420,104 | 12/1983 | DiIenno | 224/250 |
| 4,432,477 | 2/1984 | Haidt et al. | 224/222 |
| 4,500,019 | 2/1985 | Curley, Jr. | 224/222 |
| 4,509,667 | 4/1985 | Meldrum | 224/901 |
| 4,690,316 | 9/1987 | Peterson | 224/253 |
| 4,715,364 | 12/1987 | Noguchi | 2/311 |
| 4,728,123 | 3/1988 | Kassal et al. | 224/220 |
| 4,733,808 | 3/1988 | Turner, Jr. et al. | 224/219 |
| 4,771,927 | 9/1988 | Ventura | 224/252 |
| 4,848,624 | 7/1989 | Clem | 224/222 |
| 4,856,149 | 8/1989 | Brame | 224/220 |
| 4,862,563 | 9/1989 | Flynn | 24/306 |
| 4,958,758 | 9/1990 | Tipple et al. | 224/267 |
| 4,991,234 | 2/1991 | Greenberg | 2/311 |
| 5,014,692 | 5/1991 | Rhoades | 224/901 |
| 5,033,142 | 7/1991 | Templeton | 7/167 |
| 5,154,506 | 10/1992 | Leard | 224/222 |
| 5,187,744 | 2/1993 | Richter | 379/449 |
| 5,214,874 | 6/1993 | Faulkner | 224/901 |
| 5,221,031 | 6/1993 | Prigmore | 224/267 |
| 5,253,292 | 10/1993 | Fluder et al. | 379/426 |

FOREIGN PATENT DOCUMENTS

| | | | |
|---|---|---|---|
| 999367 | 1/1952 | France | 224/267 |

*Primary Examiner*—Henry J. Recla
*Assistant Examiner*—Gregory M. Vidovich
*Attorney, Agent, or Firm*—Grace J. Fishel

[57] ABSTRACT

A body mountable carrier for carrying a detachable device such as a portable phone, tool, appliance or the like. The carrier has a firm mounting panel to which is attached an elastic strap. The panel and the strap are joined together with mating interlocking fastening materials and can be mounted on an arm with one hand or on a leg. The panel provides a back plane for attachment of the detachable device.

8 Claims, 2 Drawing Sheets

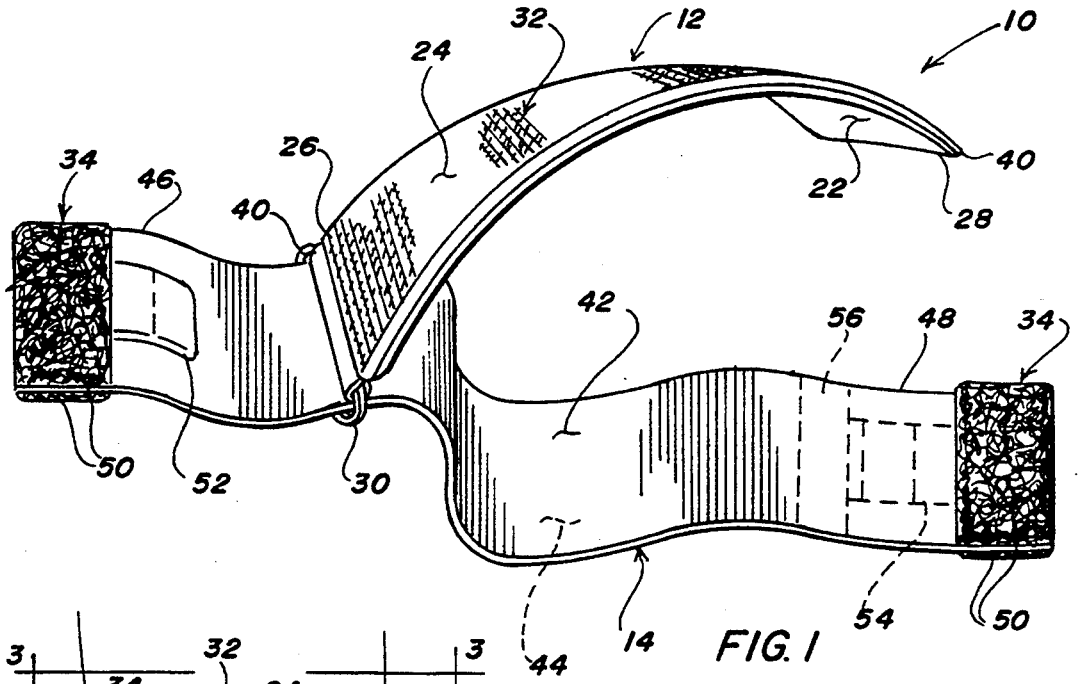
FIG. 1
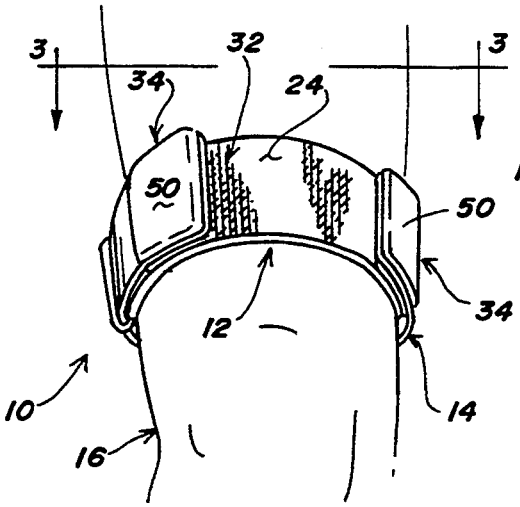
FIG. 2
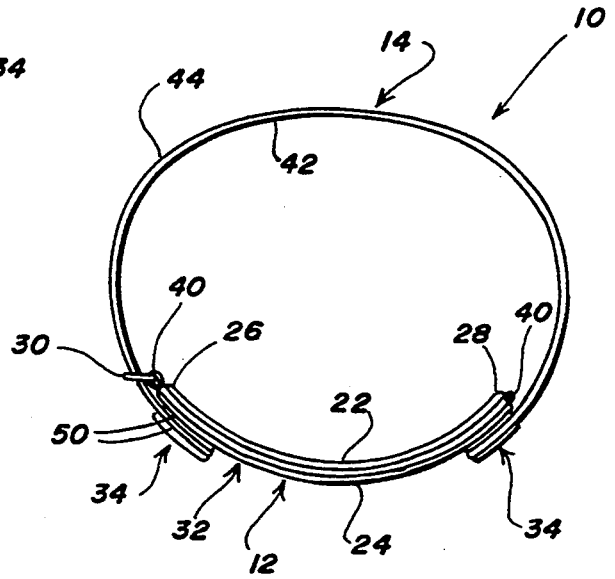
FIG. 3
FIG. 5
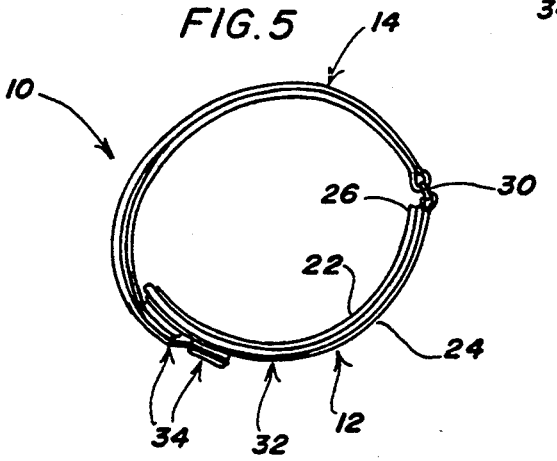

BODY MOUNTABLE CARRIER

Background of the Invention

1. Field of the Invention

The present invention relates to a body mountable carrier that can be attached to a wearer's arm or leg for carrying a detachable device such as a portable phone, tool, appliance or the like.

2. Brief Description of the Prior Art

Certain devices such as portable phones, hand tools, etc. are sometimes carried by a user working about a home, yard and so forth where continual use and laying aside of the phone or tool is required, frequently resulting in it being misplaced or left behind. Other devices commonly carried about a work site or while engaging in sports or leisure activities include appliances such as small power tools, radios, tape and compact disk players and so forth. If the user is wearing clothing having big enough pockets, he may be able to carry the phone, tool or appliance within his pocket and carriage of the device made automatic.

More frequently, however, the user does not have a suitable pocket. In such instances, the phone, tool or appliance must be, as just mentioned, repeatedly picked up and repositioned each time the user changes location to maintain the phone, tool or appliance in close proximity. As such repeated repositioning of the device is inconvenient, or the user may forget, means by which the device could be mounted on the user to ensure that the device would be carried by the user as he changes location would be beneficial.

Special purpose holsters, clip assemblies affixed to the handset, etc. have been proposed. These devices frequently have snaps, flaps and so forth making it difficult to take the device out and put it back, moreover most holsters and the like are designed for use with a particularly shaped device, requiring different holders for each item. Many holsters, clips, etc. must be attached to some other item, usually a belt or the like, which the wearer must put on and then thread, clip or otherwise attach the carrier.

In view of the above, there is a continuing need for a body mountable carrier that can be used with a wide range of different portable phones, tools, appliances and other such devices such that the device is easy to store and retrieve and so that carriage of the device is automatic as the user moves from place to place. A suitable carrier for the above-mentioned purpose must be capable of gripping different shaped devices weighing up to about five pounds, must be easy for the wearer to put on and, very importantly, not readily come apart or require attachment to some other item like a belt.

SUMMARY OF THE INVENTION

In view of the above, it is an object of the present invention to provide a body mountable carrier that can be used with a wide range of different detachable devices. It is another object to provide a carrier that is easy to attach to a limb and which does not readily come apart or require attachment to a belt or the like. Other objects and features of the invention will be in part apparent and in part pointed out hereinafter.

In accordance with the invention, a body mountable carrier for a detachable device such as a portable phone or the like includes a first mounting panel and an elastic strap. The mounting panel is capable of being shaped to conform to a body limb of a wearer. It has an inner and an outer face and first and second ends with a retaining means, such as a flat ring, attached to the first end and a first interlocking fastening material of two mating interlocking fastening materials on the outer face.

The elastic strap passes through the retaining means and has an inner and outer face and first and second ends that when attached to the panel form a band of sufficient length to encircle the body limb. The strap has a second interlocking fastening material of two mating interlocking fastening materials on the inner and outer faces of the strap at the first and second ends. The second interlocking fastening material at the first and second ends forms a thickness such that the strap is not readily pulled through the retaining means.

The invention summarized above comprises the constructions hereinafter described, the scope of the invention being indicated by the subjoined claims.

BRIEF DESCRIPTION OF THE DRAWINGS

In the accompanying drawings, in which several of various possible embodiments of the invention are illustrated, corresponding reference characters refer to corresponding parts throughout the several views of the drawings in which:

FIG. 1 a perspective view of a carrier in accordance with the present invention;

FIG. 2 is a side elevation of the carrier on a wearer's leg;

FIG. 3 is a top view of the carrier on the wearer's leg;

FIG. 5 is a top view of the carrier on the wearer's arm;

DETAILED DESCRIPTION OF THE INVENTION

Figure 4:
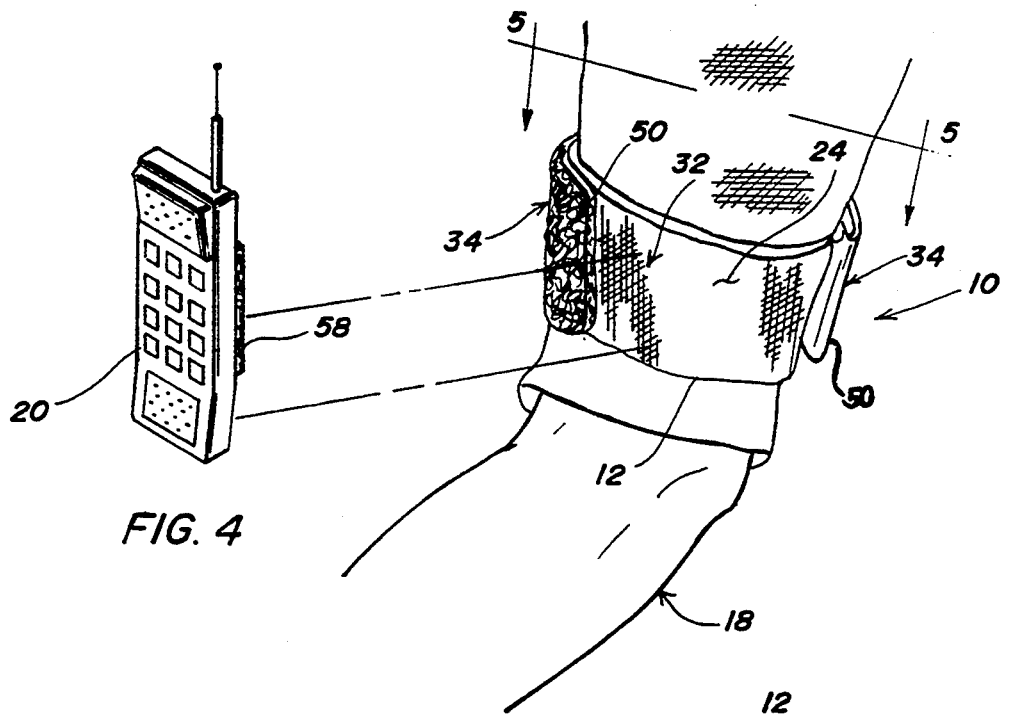
FIG. 4 is a side elevation of the carrier on a wearer's arm.

The dimensions of the transceiver comprising a cordless phone and the transceiver comprising a cellular phone make either portable and, as their costs have decreased, portable phones have become very popular. Referring to the drawings more particularly by reference character, a body mountable carrier 10 in accordance with the present invention includes in major part a firm mounting panel 12 and an elastic strap 14. Carrier 10 can be mounted on a limb such as a leg 16 as shown in FIG. 2 or an arm 18 as shown in FIG. 4 and can be used to carry a portable phone 20, a tool, an appliance or the like.

As shown in FIG. 1, mounting panel 12 is generally stiff but somewhat flexible, preferably elongate, and capable of being shaped to conform to a body limb (leg 16 or arm 18) of a wearer. As illustrated in the drawings, panel 12 is about 2 inches wide and about 8 inches long. These dimensions may vary to accommodate the needs and comforts of users of the carrier but they are preferred because of their near universal fit. Panel 12 has an inner face 22 and an outer face 24 and first and second ends 26, 28, respectively, with a retaining means 30 attached to first end 26.

In many cases, it is desirable to line inner face 22 for comfort around a bare arm or leg or for gripping a shirt sleeve or pant leg. Suitable lining materials should be non-slippery and feel comfortable against the wearer's skin such as flannel, foam rubber and so forth. As more particularly described below, outer face 24 is provisioned with a first interlocking fastening material 32 selected from a pair of mating interlocking fastening materials.

With continuing reference to FIG. 1, first interlocking fastening material 32 is a fabric with a multiplicity of hooks that are engagable with a second interlocking fastening material 34 whose use is more particularly described below. Second interlocking fastening material 34 is shown as a loosely woven pile fabric which is complimentary to the hooked fabric. First and second interlocking fastening materials 32, 34 are marketed under the trademark VELCRO and, in recent years, under various other names. As shown in FIG. 1, the entire surface of outer face 24 is covered with first interlocking fastening material 32 to provide a broad back plane for attachment of phone 20 or the like. It will be apparent that lesser amounts of outer face 24 may be covered with first interlocking fastening material 32, albeit less preferred (other than possibly for reasons of cost). It will also be apparent that first and second interlocking fastening materials 32, 34 may be reversed.

Figure 7:
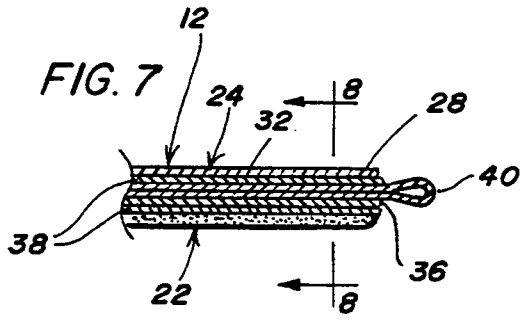
FIG. 7 is an enlarged sectional view taken along line 7—7 in FIG. 8 of an end of a panel forming a part of the carrier; and, FIG. 8 is a sectional view taken along line 8—8 in FIG. 7.
Figure 8:
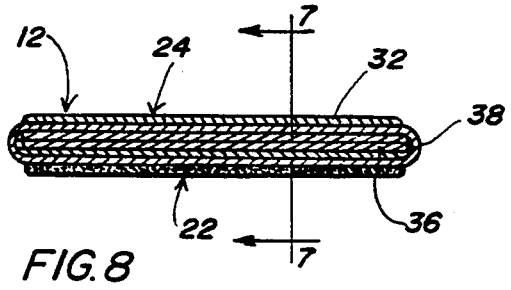

As shown in FIGS. 7–8 taken in combination with FIG. 1, panel 12 is of sandwich construction with a generally stiff belt 36 forming a core about which is wrapped a cover 38. The ends of two small loops 40 of material are tucked under cover 38 at first and second ends 26, 28 (second end 28 is shown in FIGS. 7–8) with retaining means 30, illustrated as a flat ring, attached with loop 40 to panel 12 at first end 26. Belt 36, cover 38, loops 40 and the materials forming inner and outer faces 22, 24 are then formed into a composite with adhesive, stitching or the like. In a prototype, cover 38 and loops 40 were made of a plastic material such as is used for seat covers but other suitable materials may be used.

Turning now to the second major part, elastic strap 14 is formed of a strip of fabric roughly 2 inches wide by 12 to 14 inches long. These dimensions, like the dimensions of mounting panel 12, may vary to accommodate the needs and comforts of users of the carrier but they are preferred. The currently preferred fabric is a woven material constructed of synthetic fiber having an elastically extensible character.

Strap 14 has an inner face 42 and an outer face 44 and first and second end 46, 48, respectively, and when attached to panel 12 forms a band of sufficient length to encircle leg 16 or arm 18. Patches 50 of second interlocking fastening material 34 are provided on the inner and outer faces of strap 14 at first and second ends 46, 48. For ease of construction, each of the patches of second interlocking fastening material is folded back on itself and attached at first and second ends 46, 48 with adhesive, stitching or the like. It will be apparent to those skilled in the art that patches 50 might also be separately attached on inner and outer faces 42, 44 of strap 14 by various means such as by sewing, adhesive, etc. Patches 50 form a thickness such that strap 14 is not readily pulled through the flat ring (i.e., retaining means 30).

Referring once more to FIG. 1, inner face 42 of strap 14 at first end 46 has a strip 52 of elastic material, open along side edges and tacked or otherwise attached to the strap in the middle and at opposite ends for insertion of pencils, screwdrivers or the like. A similar second strip 54 is provided on outer face 44 of strap 14 at second end 48. A patch 56 of first interlocking fastening material 34 flanks second strip 54.

In use as shown in FIGS. 2–3, carrier 10 can be mounted on leg 16, in which case, patches 50 of second interlocking fastening material 34 on inner face 42 of strap 14 are joined to first interlocking fastening material 32 on outer face 24 of panel 12. That portion of panel 12 between patches 50 is available as a back plane for attachment of a detachable device having a patch 58 of second interlocking fastening material 34. In use as shown in FIGS. 4–5, carrier 10 can also be mounted on arm 18, in which case, patch 50 on inner face 42 of strap 14 at second end 48 is attached to first interlocking fastening material 32 on the outer face of panel 12 at its second end 28. Strap 14 is pulled through ring 30 and patch 50 on outer face 44 of the strap at first end 46 is attached to patch 56 or to first interlocking fastening material 32 on the outer face of the panel. Strap 14 and panel 12 form a bigger band when the first end of strap 14 is attached to patch 56. Phone 20 with attaching patch 58 can be detachably attached to outer face 24 of panel 12 as shown in FIG. 4. As will be readily apparent from the above, carrier 10 can be mounted on arm 18 with one hand or on leg 16 since panel 12 and strap 14 are joined together with attaching means 30.

Figure 6:
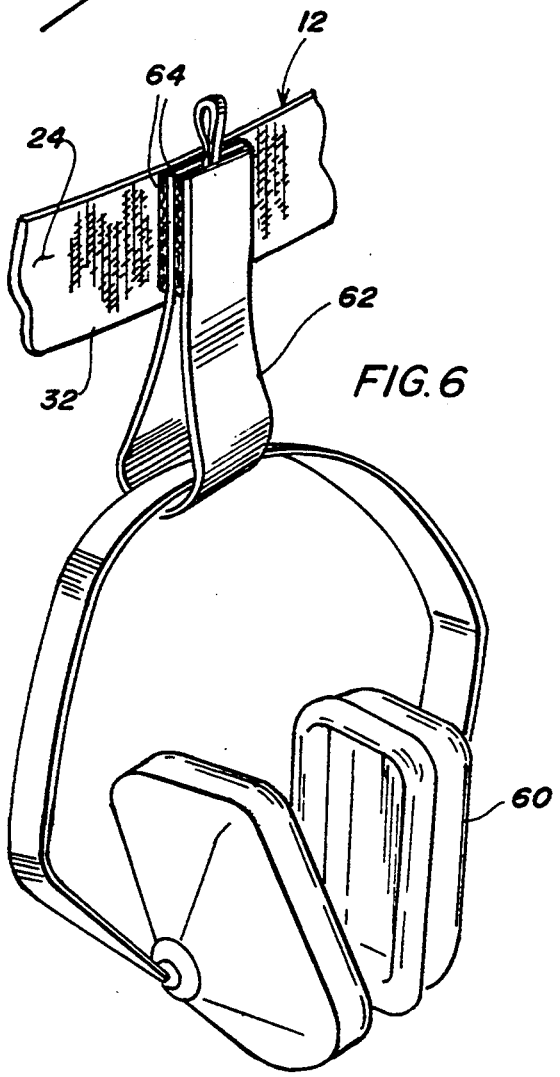
FIG. 6 is a detail showing an ear protector suspended from the carrier.

In some instances as shown in FIG. 6, the back plane formed by outer face 24 of panel 12 is not suitable for attachment of a tool such as ear protectors 60, a roll of masking tape (not shown), etc. Ear protectors 60 or the like may be attached with a strap 62 provisioned with patches 64 of first and second interlocking fastening material attached to its ends. Ear protectors 60 are held in a loop of strap 62 and the ends of strap 62 are detachably attached to the back plane of panel 12 in a manner comparable to attachment of phone 20.

In view of the above, it will be seen that the several objects of the invention are achieved and other advantageous results attained. As various changes could be made in the above constructions without departing from the scope of the invention, it is intended that all matter contained in the above description or shown in the accompanying drawings shall be interpreted as illustrative and not in a limiting sense.

What is claimed:

1. A body mountable carrier for a detachable object comprising a firm elongated mounting panel capable of being shaped to conform to a body limb of a wearer, said panel having inner and outer faces and first and second ends, a retaining means attached to said first end and a first interlocking fastening material selected from a pair of mating interlocking fastening materials secured on the outer face, an elastic strap slidably mounted through the retainer means and having inner and outer faces and first and second free ends, said strap and band having a combined sufficient length adapted to encircle the body limb, said strap having a second interlocking fastening material selected from said pair of mating interlocking fastening materials on the inner and outer faces of the strap at the first and second ends, said free ends of said strap adapted to detachably mate with said first material for mounting said carrier to the body limb, said second interlocking fastening material at the first and second ends forming a thickness such that the strap is not readily pulled through the retaining means, said first material adapted to hold the object thereon, said object having a second material adapted to be mounted thereon selected from said pair of mating interlocking fastening materials for detachable mating with said first material.

2. The carrier of claim 1 wherein the retaining means is a flat ring.

3. The carrier of claim 2 wherein the inner face of the mounting panel is lined with a material comfortable against the wearer's skin.

4. The carrier of claim 1 wherein the second interlocking fastening material at the first and second ends of the strap are patches folded back on themselves covering both the inner and outer faces.

5. The carrier of claim 4 wherein a pair of elastic strips are attached on opposite sides of the strap proximate the patches at the first and second ends, said elastic strips closed at opposite ends and open along side edges.

6. The carrier of claim 5 wherein a patch of first interlocking fastening material flanks at least one of the elastic strips.

7. The carrier of claim 1 wherein the first interlocking fastening material is a fabric with a multiplicity of hooks and the second interlocking fastening material is a fabric with a loosely woven pile complimentary to the hooked fabric.

8. The carrier of claim 1 further including a second strap with patches of first and second interlocking fastening material at first and second ends for holding a device within a loop of the second strap and attaching the second strap to the first interlocking fastening material on the outer face of the panel.

* * * * *